United States Patent [19]

Alexander

[11] Patent Number: 4,856,402

[45] Date of Patent: Aug. 15, 1989

[54] GRAND PIANO ACTIONS

[76] Inventor: James R. Alexander, 772 Burroughs, Plymouth, Mich. 48170

[21] Appl. No.: 293,989

[22] Filed: Jan. 6, 1989

[51] Int. Cl.[4] ..... G10C 3/18

[52] U.S. Cl. ..... 84/239

[58] Field of Search ..... 84/236, 237, 238, 239, 84/240, 243, 244, 245, 246, 247, 248, 249, 250, 251, 252, 253, 254, 255

[56] References Cited

U.S. PATENT DOCUMENTS

| | | | |
|---|---|---|---|
| 106,396 | 8/1870 | Oliver | 84/237 |
| 269,405 | 12/1882 | Gemunder | 84/239 |
| 424,202 | 3/1890 | Herrburger | 84/239 |
| 520,989 | 6/1894 | Herrburger | 84/239 |
| 902,439 | 10/1908 | Nickel | 84/249 |
| 1,206,509 | 11/1916 | Brown | 84/239 X |
| 1,215,489 | 2/1917 | Conover | 84/239 |
| 2,195,721 | 4/1940 | Davidson | 84/239 |
| 2,442,182 | 5/1948 | Socin | 84/239 |
| 2,620,700 | 12/1952 | Shill | 84/238 |

FOREIGN PATENT DOCUMENTS

| | | | |
|---|---|---|---|
| 11552 | of 1891 | United Kingdom | 84/239 |

*Primary Examiner*—L. T. Hix
*Assistant Examiner*—Brian W. Brown
*Attorney, Agent, or Firm*—Willian, Brinks, Olds Hofer Gilson & Lione

[57] ABSTRACT

An improvement for grand piano actions reduces unwanted friction between the repetition lever and the hammer shank. The conventional grand piano knuckle is replaced by a lever disposed generally parallel to the repetition lever and pivotally secured thereto at one end. An adjustable spring provides a force biasing the lever away from the repetition lever. A travel limit adjusts the maximum pivotal excursion of the lever relative to the repetition lever. At the opposite end of the lever, a centrally pivoted platform structure is pivotally secured. The structure includes a surface which engages the hammer shank and at least one brake surface which engages the repetition lever.

20 Claims, 2 Drawing Sheets

GRAND PIANO ACTIONS

BACKGROUND OF THE INVENTION

The invention relates generally to improvements in grand piano actions and more specifically to an assembly which replaces the knuckle on the hammer shank and reduces unwanted friction.

The modern conventional grand piano action is one of the oldest inventions in current and common use today. In fact, the basic grand piano action has undergone only minor revisions since it introduction over a century ago.

One area that has attracted parties attempting to improve the grand piano action relates to the knuckle, that is, the component disposed intermediate the repetition lever and the hammer shank which transfers energy therebetween. Specifically, attention has been directed to what is referred to as knuckle friction. The knuckle and the friction it generates has only one purpose: to effect a smooth transition in hammer support from the back check to hammer support by the repetition lever. This occurs only after the key has fully descended and the piano action has just begun its return to a quiescent state. Knuckle friction absorbs energy from the repetition lever as it suddenly applies lift to the knuckle and begins to lift the hammer shank and hammer. This prevents the hammer from jumping upward when released by the back check. A jumping hammer is perceived by the performer as a slight yet distracting jolt to the finger. Once the change in hammer support occurs knuckle friction is of no further value. Nonetheless, knuckle friction still exists.

Various improvements to piano actions have been proposed. For example, U.S. Pat. No. 106,396 teaches a piano action have an under-hammer disposed generally parallel to the hammer shank when it is at rest. The under-hammer includes an enlarged head which is acted upon by a moveable portion of the jack and which in turn contacts the portion of the hammer shank near its pivot.

U.S. Pat. No. 424,202 is intended to prevent wear upon the knuckle of the hammer shank by the jack. In this device, a pivoted finger is interposed between the repeating lever and the hammer shank. At rest, the finger is disposed parallel to the repetition lever but it is pivoted to the rider flange. The free end of the finger is acted upon by the repetition lever on one side and acts upon a knuckle secured to the hammer shank.

U.S. Pat. No. 520,989 teaches a similar finger or lever which is disposed parallel to the repetition lever and which is also pivotally secured thereto. This patent also discloses the use of a regulating screw to adjust the tension of a spring providing bias to the repetition lever.

Finally, U.S. Pat. No. 1,206,509 also teaches a grand piano action having an intermediate finger disposed generally parallel to the repetition lever and pivotally secured thereto. The finger is capable of slight independent movement with respect to the repetition lever.

The foregoing review of patents reveals attention directed to the problem of knuckle friction. The foregoing review also suggests that further improvements in grand piano actions relating to knuckle friction are both desirable and possible.

SUMMARY OF THE INVENTION

The present invention is directed at reducing unwanted friction between the repetition lever and hammer shank of a grand piano action. The invention contemplates removal of the conventional knuckle and its replacement by a lever disposed generally parallel to the repetition lever. One end of the lever is pivotally secured to the repetition lever. A bias and adjustment mechanism is disposed adjacent the pivoted end of the lever and permits adjustment of the biasing force of the lever away from the repetition lever. An adjustable travel limit is also operably disposed between the lever and the repetition lever. At the end of the lever opposite the pivot, a platform member typically taking the form of a clevis-like structure is pivotally secured to the lever. This structure includes a surface which engages the hammer shank and a brake surface typically taking the form of a pair of spaced apart pads which engage the repetition lever. The upper end of the jack is aligned with and contacts the end of the transfer lever.

The pivoted lever and platform member of the present invention thus reduce friction during key travel and provide friction at the repetition lever only when it is needed.

Thus it is an object of the present invention to provide an improvement for grand piano actions which controls knuckle friction.

It is a further object of the present invention to provide a lever for pivotal disposition upon the repetition lever of a grand piano action.

It is a still further object of the present invention to provide a lever for pivotal securement to the repetition lever of a grand piano action which further includes biasing means, bias adjustment means and travel limit adjustment.

Further objects and advantages of the present invention will become apparent by reference to the following specification and appended drawings.

DESCRIPTION OF THE PREFERRED EMBODIMENT

Figure 1:
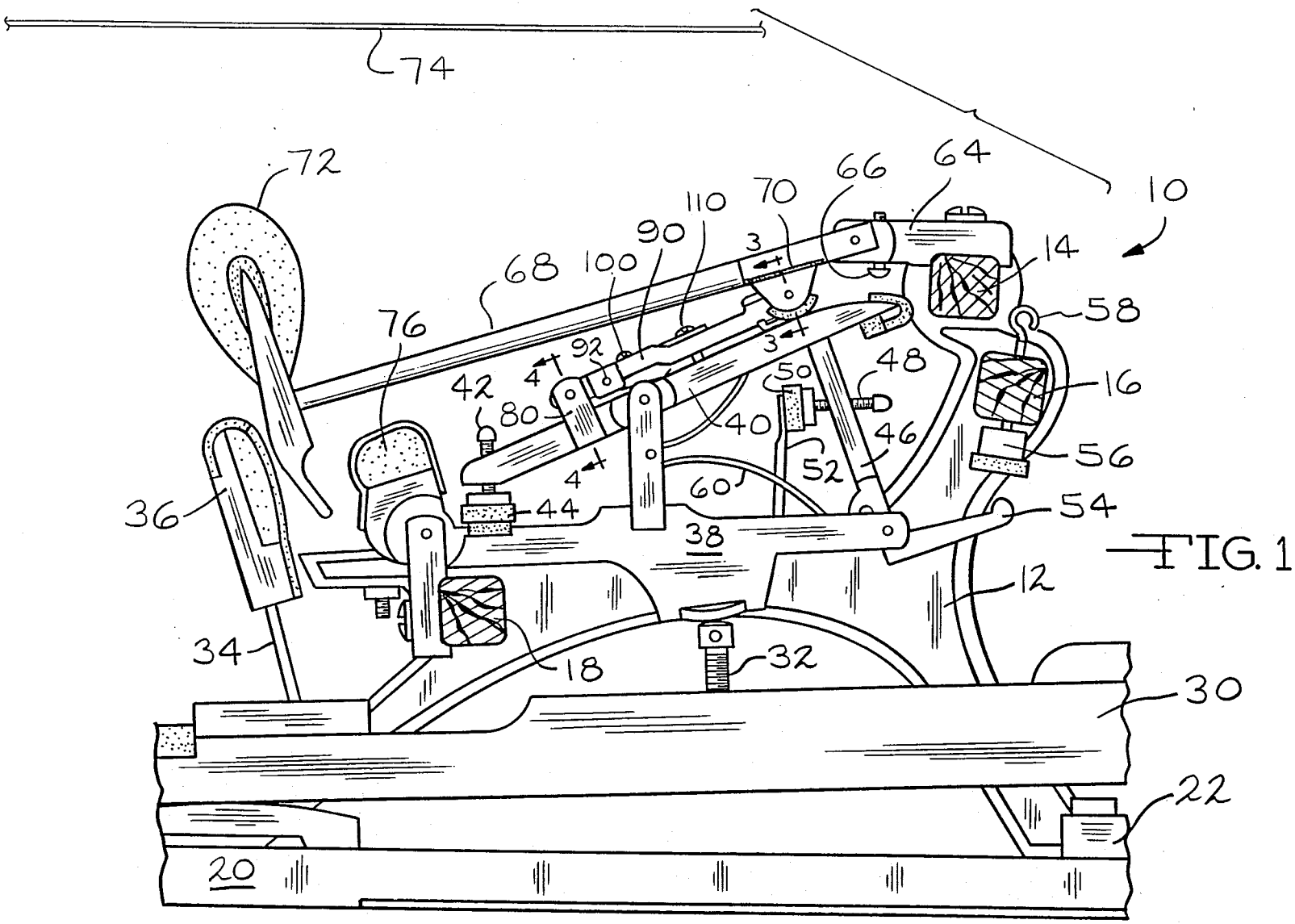
FIG. 1 is a side, elevational view of a grand piano action including a transfer lever according to the present invention.

Referring now to FIG. 1, a conventional grand piano action modified in accordance with the present invention is illustrated and generally designated by the reference numeral 10. The grand piano action 10 is in broad and common use in modern grand pianos. The grand piano action 10 is contained within piano cabinetry or a suitable housing (not illustrated) and includes an action bracket 12 which supports various rails such as the main action rail 14, the letoff rail 16 and the whippen rail 18. The main action rail 14, the letoff rail 16 and the whippen rail 18 extend along the full length of the internal mechanism of the grand piano action 10 illustrated and likewise along the full length of the piano keyboard is those familiar with such instruments will readily appreciate. A similarly extending back rail 20 and a similarly extending balance rail 22 are disposed in the lower portion of the grand piano action 10.

For each of the eighty-eight notes or pitches of a typical grand piano, there is a key 30 to which is secured a capstan screw 32, a backcheck wire 34 and backcheck 36. Similarly, for each of the eighty-eight notes or keys 30 of the grand piano, there is a corresponding whippen 38 upon which is pivotally secured and supported a repetition lever 40. At one end of the repetition lever 40 is disposed a repetition lever screw 42 which cooperates with a repetition lever button 44 secured to the whippen 38. The opposite end of the repetition lever 40 is notched and receives one end of a jack 46. Frictionally and threadably disposed in the jack 46 is a jack regulating screw 48 which terminates in a jack regulating button 50. The jack regulating button 50 is aligned with and cooperates with a whippen spoon 52 mounted upon the whippen 38. The jack 46 is pivotally secured to the whippen 38 and includes a jack tender 54 which is aligned with and cooperates with a letoff button 56. The letoff button 56 is mounted upon a letoff regulating screw 58 extending through the letoff rail 16. A formed wire spring 60 functions as a combination jack spring and repetition lever spring.

Secured to the main action rail 14 at each key 30 of the grand piano action 10 is a hammer flange 64 within which is secured a drop screw 66. Pivotally mounted and secured to the hammer flange 64 is a hammer shank 68. A felt pad 70 is attached to a flat chordal surface on the underside of the hammer shank 68 generally proximate the hammer flange 64. A hammer 72 is securely attached to the end of the hammer shank 68. Aligned with the hammer 72 in operable relationship therewith is a string 74 which produces the appropriate and desired frequency sound associated with a respective key 30. Aligned with the end of the hammer shank 68 generally proximate the hammer 72 is a hammer rest 76.

Figure 2:
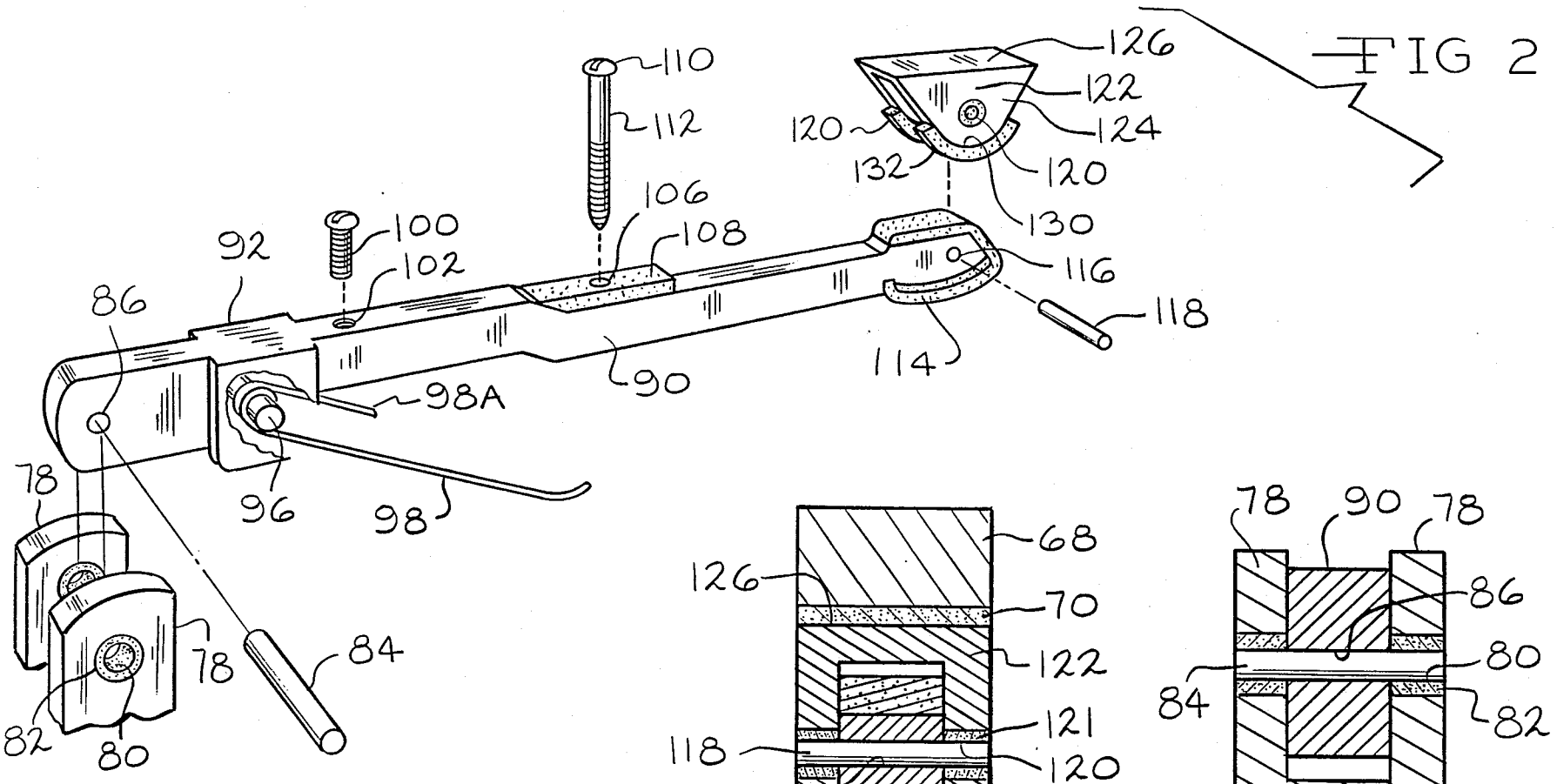
FIG. 2 is a perspective view of the transfer lever according to the present invention with a portion broken away.
Figure 4:
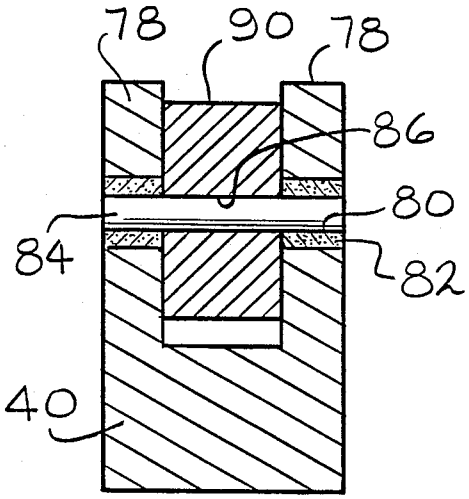
FIG. 4 is a full, sectional view of the transfer lever of the present invention in place within a grand piano action taken along line 4—4 of FIG. 1.

Referring now to FIG. 1 and especially FIGS. 2 and 4, the repetition lever 40 includes a pair of spaced apart mounting lugs or ears 78 defining aligned apertures 80. To reduce friction, the apertures 80 are preferably lined with felt bushings 82. A mounting pin 84 extends between and is received within the felt bushings 82 and is frictionally retained within an aperture 86 in a transfer lever 90. Obviously, this pivotal mounting arrangement may be reversed with the transfer lever 90 including lugs which define a throat and receive a single mountigg member on the repetition lever 40 or the repetition lever 40, itself. The transfer lever 90 is disposed generally parallel to the repetition lever 40 as illustrated in FIG. 1. The transfer lever 90 may be straight, offset as illustrated, curved or otherwise configured inasmuch as it is its function, interconnection and interaction with other elements which is important, not its specific shape. The offset configuration of the transfer lever 90 illustrated provides improved clearance between elements of the grand piano action 10. The transfer lever 90 includes a pair of spaced apart sidewall apertures 92 oriented on an axis parallel to and spaced from the aperture 86. A pin 96 is frictionally received and secured within the apertures 92 and provides mounting for a transfer lever spring 98. Alternatively, and with the addition of a suitable cavity in the transfer lever 90, the transfer lever spring 98 may be disposed about the mounting pin 84. The transfer lever spring 98 is preferably of a formed wire configuration and includes arms of disparate length. A longer arm of the spring 98 engages the upper surface of the repetition lever 40 as illustrated in FIG. 1. A threaded regulating screw 100 is frictionally received within a complementarily threaded aperture 102 in the transfer lever 90 and is aligned with the short end of the spring 98A. The axial position of the regulating screw 100 in the transfer lever 90 may be adjusted to adjust the force which the transfer lever spring 98 provides to bias the transfer lever 90 away from the repetition lever 40.

Spaced from the threaded aperture 102 and disposed along an axis parallel to it is a smooth walled aperture 106. The aperture 106 extends through the transfer arm 90 and is preferably surrounded with a felt pad 108 on the upper surface of the transfer lever 90. A threaded adjustment screw 110 having an enlarged terminal portion and a smooth, axially extending region 112 is received within the aperture 106 and is secured into the repetition lever 40. The threaded adjustment screw 110 limits the maximum pivotal translation of the transfer lever 90 about the mounting pin 84 and away from the repetition lever 40 as will be readily appreciated.

Figure 3:
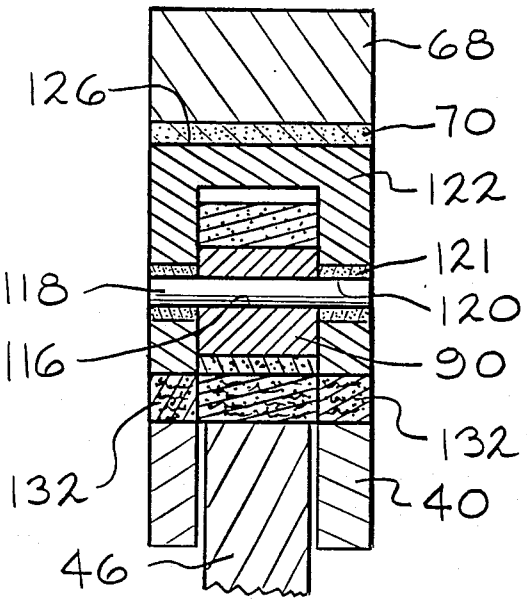
FIG. 3 is a full, sectional view of the transfer lever of the present invention in place within a grand piano action taken along line 3—3 of FIG. 1.

The following description relates to FIGS. 2 and 3. The end of the transfer lever 90 opposite the aperture 86 is preferably covered with buckskin 114 and may be further padded with felt, if desired. The buckskin 114 of the transfer lever 90 is engaged by the end of the jack 46. At the end of the transfer lever 90 covered with the buckskin 114 is another through aperture 116 having an axis parallel to the axis of the apertures 86 and 92. The aperture 116 frictionally receives a pivot pin 118 which is received within a pair of spaced apart, aligned felt bushings 120 in the sidewalls 122 of a clevis-like platform 124.

As illustrated in FIG. 3, the platform 124 is generally U-shaped in cross section and includes a generally planar surface 126 which aligns with the felt pad 70 on the hammer shank 68 as illustrated in FIG. 1. The spaced apart sidewalls 122 of the platform 124 include curved lower surfaces 130 to which are secured friction producing brake pads 132. The brake pads 132 may be fabricated of buckskin or other material with similar frictional characteristics. The brake pads 132 engage the upper surface of the repetition lever 40 generally adjacent the jack 46. Alternatively, it should be understood that the pivoted platform 124 may be configured in other shapes which include the planar surface 126 for engaging the hammer shank 68 and the curved brake pads 132 for engaging the repetition lever 40.

Referring now to all of the drawing FIGS., particularly FIG. 1, the operation of the grand piano action 10 including the transfer lever 90 will now be described. As the key 30 is struck, the jack 46 moves upwardly lifting the transfer lever 90. The transfer lever 90 raises the platform 124 which lifts the hammer shank 68, carrying the hammer 72 to the string 74. The platform 124 rotates about the pivot pin 118 as the planar surface 126 maintains contact with the hammer shank 68. Thus, the brake pads 132 rotate in controlled contact against the upper surface of the repetition lever 40. Adjustment of the degree of frictional contact between the brake pads 132 and the repetition lever 40 is accomplished by adjustment by rotation of the threaded regulating screw 100.

As the hammer 72 approaches the string 74, the jack tender 54 is tripped by the letoff button 56 and the jack 46 disengages the transfer lever 90. Next, the hammer 72 strikes and then rebounds from the string 74. The hammer shank 68 is in contact with the platform 124 and, as the hammer 72 and the hammer shank 68 descends, the platform 124 likewise descends. As the momentum of the hammer 72 and the hammer shank 68 overcomes the bias of the transfer lever spring 98, and without the support of the jack 46, the transfer lever 90 pivots slightly downward or clockwise as viewed in FIG. 1. As the transfer lever 90 descends, the brake pads 132 again contact the upper surface of the repetition lever 40, forcing the repetition lever 40 down against the combination jack and repetition lever spring 60. Since the platform 124 remains in contact with the hammer shank 68, the platform 124 will rotate, causing friction at the point of contact between the brake pads 132 and the repetition lever 40.

Typically, when the key 30 is at full dip, the hammer 72 will fully descend and be caught in the backcheck 36. When pressure on the key 30 is relaxed, the backcheck 36 releases the hammer 72. The repetition lever 40, under the influence of the now compressed spring 60, applies a lifting force to the platform 124. The brake pads 132 cause friction which resists rotation of the platform 124 which slows the upward, return motion of the repetition lever 40 thereby preventing rapid motion or jumping of the hammer 72 and the hammer shank 68. The repetition lever 40 carries the transfer lever 90, the platform 124, the hammer shank 68 and the hammer 72 upward until the repetition lever 40 contacts the drop screw 66. So supported, the transfer lever 90 awaits the return of the jack 46 as the key 30 is released and the whippen 38 begins its descent. The jack 46 then slips readily under the buckskin 114 of the transfer lever 90. The platform 124 again rotates about the pivot pin 118 as the hammer 72 and the hammer shank 68 descend. The transfer lever spring 98 provides a counterforce to the combination jack spring and repetition lever spring 60. As a result, the repetition lever 40 achieves only minimal frictional engagement with the brake pads 132 during the rotation of the platform 124. This reduces friction during the upstroke of the key 30. The key 30 then returns to its at rest position with little resistance.

The foregoing disclosure is the best mode devised by the inventor for practicing this invention. It is apparent, however, that apparatus incorporating modifications and variations will be obvious to one skilled in the art of piano actions. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

I claim:

1. In a piano action having a repetition lever and a hammer shank, the improvement comprising a lever pivotally secured at one end to said repetition lever, platform means pivotally secured to the other end of said lever for engaging said hammer shank, said platform means including brake means for engaging said repetition lever.

2. The improvement of claim 1 further including means for limiting the pivotal travel of said lever relative to said repetition lever.

3. The improvement of claim 1 further including means for biasing said lever away from said repetition lever.

4. The improvement of claim 3 wherein said biasing means includes means for adjusting said biasing means.

5. The improvement of claim 1 wherein said lever includes an offset portion.

6. The improvement of claim 1 further including a pair of spaced apart ears extending from said repetition lever and a respective pair of felt bushings disposed in said ears and wherein said platform means includes a planar surface and felt bushings.

7. The improvement of claim 1 wherein said platform means includes a planar surface aligned with said hammer shank.

8. The improvement of claim 1 wherein said platform means is a clevis having a surface engaging said hammer shank.

9. The improvement of claim 1 wherein said brake means includes a pair of spaced apart curved surfaces.

10. A piano action comprising, in combination, at least a repetition lever, a hammer shank, and a transfer lever, means for pivotally securing said transfer lever to said repetition lever, means pivotally secured to said transfer lever for engaging said hammer shank, said engaging means spaced from said pivotally securing means and defining surface means for engaging said hammer shank and brake means for engaging said repetition lever.

11. The piano action of claim 10 wherein said engaging means includes a pivot pin and said surface means and said brake means are disposed on opposite sides of said pivot pin.

12. The piano action of claim 10 further including means for adjusting the maximum motion of said transfer lever relative to said repetition lever.

13. The piano action of claim 10 further including means for biasing said transfer lever away from said repetition lever.

14. The piano action of claim 13 further including means for adjusting the bias of said biasing means.

15. The piano action of claim 13 wherein said biasing means is a formed wire spring.

16. The piano action of claim 10 wherein said brake means includes a pair of curved, spaced apart surfaces.

17. In a grand piano action including a jack, a repetition lever, and a hammer shank, the improvement comprising, a lever operably disposed between said repetition lever and said hammer shank and pivotally secured at one end to said repetition lever, a member pivotally secured to the other end of said lever, said member having a first surface disposed for contact with said hammer shank and a second surface disposed for contact with said repetition lever.

18. The improvement of claim 17 wherein said first surface is planar and said second surface is curved.

19. The improvement of claim 17 further includes means for providing a force urging said lever away from said repetition lever.

20. The improvement of claim 17 further including adjustable means for limiting the maximum pivotal movement of said lever relative to said repetition lever.

* * * * *